United States Patent [19]

Heinen

[11] 4,300,265

[45] Nov. 17, 1981

[54] BREAK-UP ROLLER FOR OPEN-END SPINNING MACHINE

[75] Inventor: Helmut Heinen, Mönchengladbach, Fed. Rep. of Germany

[73] Assignee: Reiners & Furst, Mönchengladbach, Fed. Rep. of Germany

[21] Appl. No.: 963,757

[22] Filed: Nov. 27, 1978

[30] Foreign Application Priority Data

Nov. 25, 1977 [DE] Fed. Rep. of Germany ..... 2752591

[51] Int. Cl.[3] ..... D01G 19/10

[52] U.S. Cl. ..... 19/112; 19/97; 29/121.1; 57/58.91

[58] Field of Search ..... 29/121.1, 121.2, 121.4, 29/121.5, 124, 125, 116 R, 123, 148.4 D, 23; 57/58.91, 58.95; 15/198; 19/97, 112

[56] References Cited

U.S. PATENT DOCUMENTS

| | | | |
|---|---|---|---|
| 444,675 | 1/1891 | Seror | 15/198 |
| 2,616,633 | 11/1952 | Reynolds | 29/129 |
| 2,636,221 | 4/1953 | Meadows et al. | 29/116 R |
| 2,938,242 | 5/1960 | Schiltknecht | 29/129 X |
| 3,097,022 | 7/1963 | Sernetz | 29/116 R |
| 3,624,997 | 12/1971 | Didek et al. | 57/58.95 X |
| 4,163,304 | 8/1979 | Laflaquiere et al. | 19/97 |
| 4,196,496 | 4/1980 | Stauffer et al. | 19/97 |
| 4,208,767 | 6/1980 | Schmolke | 19/112 X |

FOREIGN PATENT DOCUMENTS

| | | | |
|---|---|---|---|
| 311079 | 2/1919 | Fed. Rep. of Germany | 29/121.2 |
| 7106617 | 8/1971 | Netherlands | 19/112 |
| 1172 | of 1852 | United Kingdom | 19/98 |
| 416233 | 9/1934 | United Kingdom | 29/121.1 |
| 1234327 | 6/1971 | United Kingdom . | |
| 1502940 | 3/1978 | United Kingdom . | |

*Primary Examiner*—Louis Rimrodt

*Attorney, Agent, or Firm*—Herbert L. Lerner

[57] ABSTRACT

Break-up roller with card clothing for an open-end spinning frame including a base member, and an inherently stable, exchangeable ring carrying the card clothing and lockingly connected to the base member.

12 Claims, 10 Drawing Figures

BREAK-UP ROLLER FOR OPEN-END SPINNING MACHINE

The invention relates to a break-up roller with card clothing or needle-like fittings for an open-end spinning machine or frame. The break-up roller is conventionally fastened on the through shaft of a journal bearing which is constructed as an antifriction bearing. The shaft is equipped with a drive whorl or pulley.

Such a break-up roller breaks up or loosens the fibers of the sliver into individual fibers and transports them to the fiber guide channel of the open-end spinning machine. The card clothing is formed either of sawtooth wire or of needles. Sawtooth wire is peened or wedged into thread-like turned grooves at the circumference of the break-up roller. The sawtooth wire is hardened and polished so that wear remains low and no fibers are caught therein. The card clothing of sawtooth wire is made differently for cotton and synthetic or chemical fibers. The differences involve the tooth pitch and the shape of the teeth. Needle clothing, on the other hand, has the advantage of universal applicability. Also, there is less wear therewith.

The break-up roller is customarily driven at a speed of 5,000 to 12,000 r.p.m. by means of a tangential belt which extends over an entire side of the machine. There are also other possibilities for driving the rollers. The speed thereof depends on the material to be processed.

The break-up roller conventionally forms an exchangeable structural unit together with the antifriction bearing, the shaft and the pulley or whorl. Heretofore, this structural unit used to be balanced as a unitary assembly. After the clothing was worn out, the entire assembly used to be replaced. The new clothing used to be applied at the manufacturing plant. After being provided with new clothing, the assembly had to be rebalanced each time. All together, the user had to have a large supply of complete assemblies.

It is accordingly an object of the invention to provide an improved break-up roller of the foregoing type which affords a reduction in the stock of spares, makes the stocking of replacement parts more cost-effective and simplifies and speeds up the replacement of rapidly wearing parts.

With the foregoing and other objects in view, there is provided, in accordance with the invention, a break-up roller with card clothing for an open-end spinning frame comprising a base member, and an inherently stable, exchangeable ring carrying the card clothing and lockingly connected to the base member.

In accordance with another feature of the invention, a clamping element clampingly connects the ring to the base member.

In accordance with a further feature of the invention, the clamping element connection is a screw connection.

In accordance with an added feature of the invention, the clamping element is inherently resilient.

In accordance with an additional feature of the invention, the break-up roller includes a device disposed between the base member and the clamping element for retaining the clamping element.

In accordance with yet another feature of the invention, the clamping element retaining device is inherently adjustable for retaining the clamping element.

In accordance with yet a further feature of the invention, the clamping element retaining device is a resilient ring.

In accordance with yet an added feature of the invention, the resilient ring has a crown formed of springy tangentially extending projections.

In accordance with yet an additional feature of the invention, the resilient ring has a crown formed of springy radially outwardly extending projections.

In accordance with another feature of the invention, the clamping element comprises a cover connectible to the base member and pressing the ring axially against the base member.

In accordance with a further feature of the invention, the base member is formed with a central screw thread and the cover is formed with a central nut thread matching the central screw thread.

In accordance with an added feature of the invention, the base member and the cover are formed with abutment surfaces for fixing the mutual positions thereof.

In accordance with a concomitant feature of the invention, the abutment surfaces are disposed so that the ring is stressed in axial direction, in assembled condition of the break-up roller.

The following advantages are attained by means of the invention. The disassemblable, multi-partite construction of the break-up roller permits balancing of the base member with the shaft and the pulley or whorl and the ring carrying the card clothing, respectively, by themselves. The balancing bores or abrasion surfaces can then be disposed on the base member and, if desired, on the clamping element or lid in such a manner that, after assembly with the ring, an outer surface free of balancing bores or abrasion surfaces is provided. Beyond the card clothing, a smooth surface can be provided which presents no possibility any longer for accumulation of slubs and dirt, so that neither the air supply nor the quiet running of the machine can be affected adversely thereby.

In essence, the user has to maintain or store only a supply of rings equipped with clothing as spares. The rings are exchanged or replaced by the user and no longer by the manufacturer. Stocking of spares and also procurement and use of spare parts are more economical overall.

Since the parts are balanced separately, no further balancing is necessary after assembly.

Other features which are considered as characteristics for the invention are set forth in the appended claims.

Although the invention is illustrated and described herein as embodied in a break-up roller for open-end spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
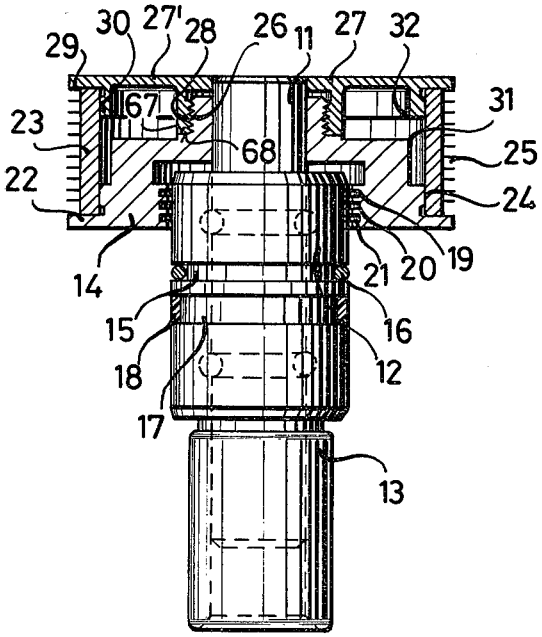

Referring now to the drawing and first particularly to FIG. 1 thereof, there is shown a break-up roller with a shaft 11 of an antifraction bearing 12 and a drive pulley or whorl 13 fastened to the shaft 11. A base member 14 of the break-up roller is also fastened to the shaft 11.

Into the outer surface of the antifriction bearing 12, there is incised a groove 15 in which an O-ring 16 is received, and another groove 17 in which a plastic ring 18 is received. The plastic ring 18 and groove 17 construction serves for effecting sealing thereof with respect to a non-illustrated housing. In the base member 14, sealing grooves 19, 20 and 21 are formed which serve to prevent dust and dirt from penetrating into the antifriction bearing 12.

The base member 14 forms a rim 22, against which a ring 23 is braced. The base member 14 further has a concentric or coaxial cylindrical surface 24 engaging with the ring 23. The ring 23 carries card clothing 25 which, in the use at hand, are formed of needles.

In the upper part of the base member 14, as shown in FIG. 1, there is provided a screw thread 26, onto which a clamping element 27 is screwed. The clamping element 27 is formed of a spring-elastic or resilient lid which is connected to the base member 14 and presses the ring 23 in axial direction against the base member 14. For this purpose, the lid 27 is formed with a female thread 28 matching the screw thread 26 of the base member 14.

The clamping element 27 constructed as a lid also has a rim 29, which the ring 23 engages axially, and a cylindrical centering surface 30 for centering the ring 23. The clamping element 27 is centered by a fit on the shaft 11.

In producing the base member 14 and the clamping element 27, care is taken that in screwed-together condition thereof, the rims 22 and 29 are spaced a somewhat smaller distance from each other than is visible in FIG. 1. This is achieved by stop surfaces for fixing the mutual position thereof. The base member 14 has a circular stop surface 67 and the lid-shaped clamping element 27 has a similar stop surface 68. In the circular zone 27', the clamping element 27 is especially made spring-elastic or resilient. In assembled condition as shown in FIG. 1, an axial force, which keeps the ring 23 frictionally connected to the base member 14, is exerted on the ring 23 for these reasons.

Abrasion surfaces for balancing out or equalization can be provided at the edge or corner 31 of the base member 14 and at the edge or corner 32 of the clamping element 27.

Figure 2:
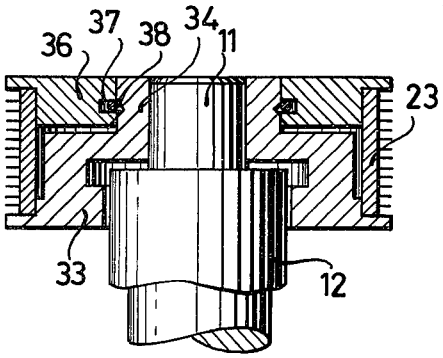
FIGS. 1 and 2 are sectional views of two different embodiments of the break-up roller constructed in accordance with the invention.

In the second embodiment of the invention according to FIG. 2, the shaft 11 of the antifriction bearing 12 is again shown. The construction of the base member 33 connected to the shaft 11 is somewhat different from that of the embodiment of FIG. 1. In a neck portion 34, thereof, as shown in FIG. 3, the base member 33 is formed with a groove 35 of V-shaped cross section.

Figure 3:
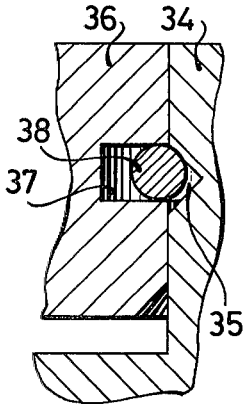
FIG. 3 is an enlarged fragmentary view of FIG. 2.

In this embodiment of FIGS. 2 and 3, a clamping element formed of a cover or lid 36 connectible to the base member 33 presses the ring 23 axially against the base member 33. The lid 36 and the neck portion 34 are joined with a sliding fit. At the inner circumference thereof, the lid 36 is formed with a groove 37 in which a radially inwardly yielding spring-elastic or resilient ring 38 is disposed, the ring 38 being slotted at the periphery thereof. After the parts are assembled together, the lid 36 exerts an axial force upon the ring 23 resulting from the fact that the ring 38 continuously strives to assume a smaller ring diameter due to the resilience thereof. The ring 38 is thus forced to engage the upper shoulder of the groove 35, whereby an axially downwardly-directed force is exerted on the lid 36.

Figure 4:
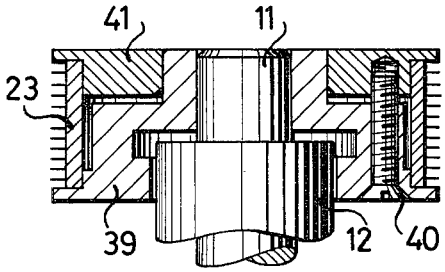
FIGS. 4 and 5 are views similar to those of FIGS. 1 and 2 of two additional different embodiments of the invention.

In the embodiment of the invention according to FIG. 4, the shaft 11 of the antifriction bearing 12 is again shown in the figure. The base member 39 is formed with three bores distributed over the circumference thereof and extending parallel to the central axis of the base member 39. Countersunk screws 40 are fitted into the bores. The clamping element again has the form of a lid 41 which is connectible to the base member 39 and presses the ring 23 axially against the base member 39. The lid 41 has three tapped holes distributed about the periphery thereof and into which the threads of the countersunk screws 40 fit. In this embodiment of FIG. 4, the connection between the clamping element 41 and the base member 39 is thus a screw connection 40.

Figure 5:
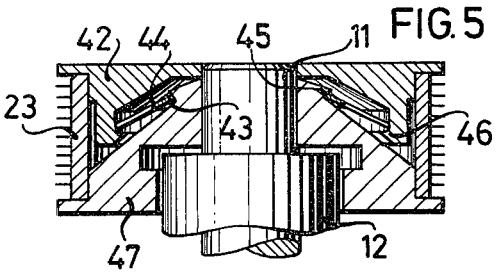
Figure 6:
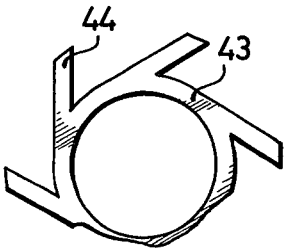
FIG. 6 is a top plan view of a spring ring forming part of the embodiment of FIG. 5.

FIGS. 5 and 6 show yet another embodiment of the invention. In FIG. 5, too, the shaft 11 of the antifriction bearing 12 is shown. A base member 47 is connected to the shaft 11 and carries the ring 23. On top thereof is a clamping element 42 in the form of a lid.

The device for readjusting and holding the clamping element 42 is formed of a spring or resilient ring 43 having six extensions 44 that are uniformly distributed over the circumference thereof and point tangentially outwardly. When manufactured, the spring ring 43 with its extensions 44 is a planar structure. However, when this planar structure is inserted between a shoulder 45 of the base member 47 and a shoulder 46 of the clamping element 42, then the entire structure arches into the shape of a conical roof after the clamping element 42 is pressed down against the ring 23, as shown in FIG. 5. Radially and, simultaneously, axially downwardly directed forces are accordingly transmitted to the clamping element 42 through the extensions 44, resulting in an axial compression of the ring 23.

Figure 7:
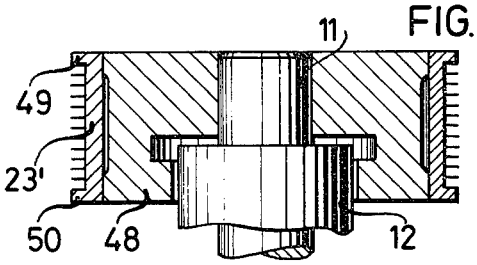
FIGS. 7, 8 and 9 are views similar to those of FIGS. 1 and 2 of three additional different embodiments of the break-up roller.

A very simple embodiment of the invention is shown in FIG. 7. As in the other illustrated embodiments, the shaft 11 of the antifriction bearing 12 is also shown in FIG. 7. The base member 48 has a somewhat cylindrical shape. The ring 23' is equipped with two rims 49 and 50 and is removably or releasably pressed onto the base member 48.

Figure 8:
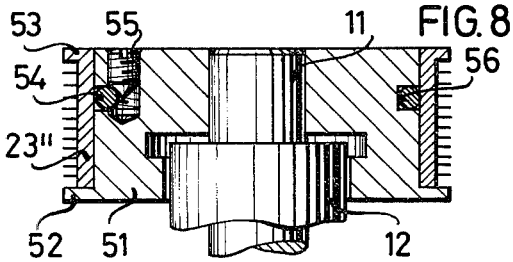

A further embodiment according to FIG. 8 again shows the shaft 11 of the antifriction bearing 12. A base member 51, which is formed with a rim 52, is connected to the shaft 11. Otherwise, the base member 51 has a cylindrical outer surface which carries a ring 23" provided with card clothing. The ring 23" has a rim 53 at the top thereof as shown in FIG. 8. The clamping element disposed between the base member 51 and the ring 23" is formed, in this embodiment of FIG. 8, of a ring 54 which is cut or split in cross-sectional direction thereof. Due to being split or cut, the ring 54 is able to engage or lie up against the ring 23" the instant the screws 55 which are disposed in the base member 51, uniformly distributed over the circumference thereof, are tightened. The base member 51 is formed with an outer groove 56 for receiving the ring 54 therein.

Figure 10:
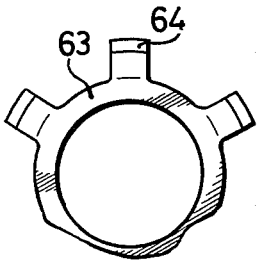
FIG. 10 is a top plan view of a spring ring forming part of the embodiment of FIG. 9.
Figure 9:
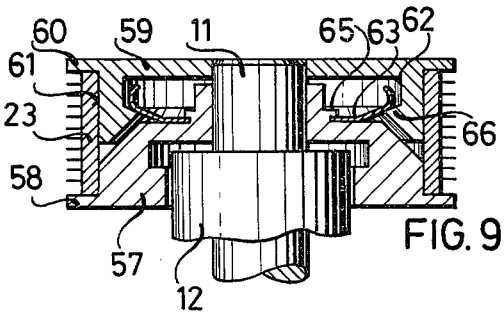

The final illustrated embodiment of the invention is shown in FIGS. 9 and 10. The shaft 11, in the embodiment of FIG. 9, carries a base member 57 with a rim 58, against which the ring 23 makes contact. The clamping element 59, which is installed from above, as viewed in FIG. 9, is provided with a rim 60 and a cylindrical contact surface 61 for engaging the ring 23. The base member 57 and the clamping element 59 are constructed so that an annular cavity 62 is formed into which a spring ring 63 is introduced. A spring or resilient ring 63 has six extensions 64, which are uniformly distributed over the circumference thereof and extend radially outwardly. When manufactured, this spring ring 63 is not a planar structure. The extensions 64 are rather bent upwardly in a hook-like manner. At a circular shoulder 65, the spring ring 63 is connected to the base member 57 by being peened or wedged thereover. The extensions or projections 64 of the spring ring 63 form a snap-in connection with an annular, circular shoulder 66 of the lid-shaped clamping element 59. After the extensions 64 snap-in behind the shoulder 66, an axial force is likewise exerted on the ring 23 in this manner.

As mentioned hereinbefore, the invention is not limited to the embodiments shown and described.

There are claimed:

1. Break-up roller with card clothing for an open-end spinning frame comprising a base member, an inherently stable, exchangeable ring carrying the card clothing and being lockingly connected to said base member at a given location, said base member having surfaces each being substantially continuous and extended in one plane except for said given location, and a clamping element clampingly connecting said ring to said base member.

2. Break-up roller according to claim 1 wherein the clamping element connection is a screw connection.

3. Break-up roller according to claim 1 wherein said clamping element is inherently resilient.

4. Break-up roller according to claim 1 including a device disposed between said base member and said clamping element for retaining said clamping element.

5. Break-up roller according to claim 1 wherein said clamping element retaining device is inherently adjustable for retaining the clamping element.

6. Break-up roller according to claim 4 wherein said clamping element retaining device is a resilient ring.

7. Break-up roller according to claim 6 wherein said resilient ring has a crown formed of springy tangentially extending projections.

8. Break-up roller according to claim 6 wherein said resilient ring has a crown formed of springy radially outwardly extending projections.

9. Break-up roller according to claim 1 wherein said clamping element comprises a cover having surfaces each being substantially continuous and extended in one plane, said cover being connectible to said base member and pressing said ring axially against said base member.

10. Break-up roller according to claim 9 wherein said base member is formed with a central screw thread and said cover is formed with a central nut thread matching said central screw thread.

11. Break-up roller according to claim 9 wherein said base member and said cover are formed with abutment surfaces for fixing the mutual positions thereof.

12. Break-up roller according to claim 11 wherein said abutment surfaces are disposed so that said ring is stressed in axial direction, in assembled condition of the break-up roller.

* * * * *